United States Patent [19]

Zverev et al.

[11] 4,231,518

[45] Nov. 4, 1980

[54] APPARATUS FOR EXPLOSIVE APPLICATION OF COATINGS

[76] Inventors: Anatoly I. Zverev, ulitsa Bratislavskaya, 26, kv. 22, Kiev; Alexandr S. Bondarenko, ulitsa Nizhegorodskaya, 26, kv. 40, Moscow, both of U.S.S.R.

[21] Appl. No.: 23,895

[22] Filed: Mar. 26, 1979

Related U.S. Application Data

[62] Division of Ser. No. 788,925, Apr. 19, 1977.

[51] Int. Cl.[2] ..... B05B 1/24

[52] U.S. Cl. ..... 239/81; 239/85

[58] Field of Search ..... 239/79, 80, 81, 85, 239/143; 406/91, 138

[56] References Cited

U.S. PATENT DOCUMENTS

| | | | |
|---|---|---|---|
| 3,129,889 | 4/1964 | Cape | 239/85 |
| 3,150,828 | 9/1964 | Pelton et al | 239/85 X |
| 3,236,422 | 2/1966 | Bailey et al. | 406/91 |
| 3,281,077 | 10/1966 | Cape | 239/85 |
| 3,476,320 | 11/1969 | Fleischhacker et al. | 239/85 |
| 4,004,735 | 1/1977 | Zverev et al. | 239/79 |

*Primary Examiner*—Richard A. Schacher

*Attorney, Agent, or Firm*—Lackenbach, Lilling & Siegel

[57] ABSTRACT

The apparatus comprises an explosion chamber made in the form of a tube closed at one end and accommodating at least one spark plug. The explosion chamber communicates with a chamber for preparation of an explosive mixture and with a batcher metering pulverulent coating material. The batcher includes a mixing chamber communicating with a hopper via a passage. The passage accommodates a device for controlling its cross-sectional area and is provided with a jet nozzle for positively feeding the coating material to the explosion chamber. A partition wall of a gas-permeable material is mounted within the hopper in equally spaced relation to the walls thereof to define an annular space communicating with a compressed gas source prevent self-compaction of the powder. A non-return valve is mounted in the portion of the batcher passage connected to the hopper to close the passage in case of back impact from the explosion chamber.

This apparatus provides for more reliable cyclic batching of pulverulent coating material fed to the explosion chamber and is reliably protected against break-through of gas in case of back impacts from the explosion chamber as compared with conventional apparatus of the same type. This considerably improves the quality of coatings, especially when finely comminuted pulverulent coating materials based on refractory compounds are used.

5 Claims, 4 Drawing Figures

APPARATUS FOR EXPLOSIVE APPLICATION OF COATINGS

This is a division of application Ser. No. 788,925, filed Apr. 19, 1977.

FIELD OF THE INVENTION

The invention relates to equipment using the effect of detonation of gases and, in particular, to an apparatus for explosion application of coatings by atomizing pulverulent coating materials with combustion products of an explosive mixture.

The present invention may be most advantageously used for application of coatings using finely comminuted powders of materials on the basis of refractory compounds, such as tungsten, chromium and molybdenum carbides.

DESCRIPTION OF THE PRIOR ART

Known in the art are apparatus for explosive application of coatings comprising an explosion chamber made in the form of a tube closed at one end and accommodating at least one spark plug and communicating with a chamber for preparation of explosive mixture and with a batcher for metering pulverulent coating material. The batcher meters the coating material via a mixing chamber of the batcher which communicates with a hopper via a passage accommodating a device for controlling the cross-sectional area of the passage, the mixing chamber having a jet nozzle for positively feeding pulverulent coating material to the explosion chamber.

The explosion chamber of the apparatus of the above-described type comprises a calibrated cylindrical tube, the length and diameter of the tube being selected based on the conditions sufficient for initiation and propagation of a detonation wave in the chamber as a result of an explosion of explosive mixture. The detonation wave has a high pressure and temperature and propagates at a constant velocity which is the maximum possible for given explosive and conditions and is as high as 2–4 km/s.

The chamber for preparation of explosive mixture is provided with valves incorporated in the walls thereof for admitting to the inner space thereof components of the explosive mixture: fuel gas, an oxidizer and neutral purging gas.

The apparatus is provided with an electronic control unit.

Following the command from the control unit, the valves of the chamber for preparation of explosive mixture are opened in a predetermined sequence, and the explosive mixture formed in the mixing space of this chamber is fed to the explosion chamber to which a pulverulent coating material is concurrently fed from the mixing chamber of the batcher. Then the chamber for preparation of explosive mixture is purged with a neutral gas, and the explosive mixture is detonated by means of the spark plug in the explosion chamber.

As a result of the detonation of the explosive mixture there are provided a high pressure and temperature in the explosion chamber, and an intensive release of gaseous explosion products occurs which are strongly compressed at the moment of detonation and constitute the physical agents the conversion of which results in an instantaneous transformation of potential energy of the explosive mixture into kinetic energy of moving gases.

This energy is transmitted to the particles of pulverulent coating material suspended in the gas flow so that the particles are heated, their motion is accelerated and they short out from the open end of the explosion chamber to form a coating on the surface of a workpiece placed in face of the chamber.

The main disadvantage of such apparatus for explosive application of coatings is that, when using very fine pulverulent coating materials, the material is self-compacted in the hopper thus resulting in a non-uniform supply of the powder to the mixing chamber of the batcher and therefrom to the explosion chamber. Thus the cyclic feeding of pulverulent coating material is interrupted and the quality of the coating as a whole is impaired.

In addition to the disadvantages of known apparatus of the above-described type, by virtue of the peculiar nature of the process of explosive coating application, backward detonation waves propagate uniformly in all directions thus requiring additional structural and processing measures for protecting the assemblies of the apparatus, as well as the pulverulent coating material, against the action of the elevated pressure and temperature imposed by back impacts.

The experience of operation of the conventional apparatus shows that particular attention aimed at improving the reliability of operation and obtaining uniform high-grade coatings should be given to the means providing cyclic feeding of a batch of pulverulent coating material to a strictly definite zone of the explosion chamber, as well as to the measures enabling more complete mixing of the explosive mixture and the pulverulent coating material. That is, it is required that particles of the material be uniformly distributed over the flow of explosion products and occupy the smallest possible compact portion extending lengthwise of the explosion chamber.

SUMMARY OF THE INVENTION

It is an object of the invention to provide an apparatus for explosive application of coatings having a construction of assemblies which enables cyclic feeding of batches of pulverulent coating material to the explosion chamber and reliable protection of the apparatus assemblies against the action of high pressure and temperature upon popping-back of a detonation wave from the explosion chamber, thereby improving the quality of coatings and ensuring reliable operation of the apparatus as a whole.

This and other objects are accomplished by an apparatus for explosive application of coatings, wherein an explosion chamber comprises a tube closed at one end, accommodates at least one spark plug and communicates with a chamber for preparation of explosive mixture and with a batcher for pulverulent coating material. The batcher includes a mixing chamber communicating with a hopper via a passage accomodating a device for controlling the cross-section of the passage, the mixing chamber having a jet nozzle for positively feeding pulverulent coating material to the explosion chamber. According to the invention, there is provided a partition wall of a gas-permeable material mounted within the hopper in equally spaced relation to the walls thereof to define an annular space communicating with a compressed gas source. A non-return valve is mounted in the passage in the portion thereof connected to the hooper to close the passage upon popping-back from the explosion chamber.

This construction enables the elimination of self-compaction of pulverulent coating material in the hopper, especially when very fine powders are used, because under the action of compressed gas fed to the hopper space through the gas-permeable partition wall, "fluidization" of the pulverulent coating material takes place, thus facilitating its unobstructed flow into the batcher passage and further to the mixing chamber, thereby improving the reliability of cyclic batching of pulverulent coating material to obtain a better quality of coating application.

Further, the provision of the non-return valve in the portion of the batcher passage connected to the hopper protects the hopper against penetration of an explosion wave therein upon back impact from the explosion chamber.

This is especially important when using very fine powders as the coating material which may be easily expelled from the hopper by the explosion wave.

All the above-mentioned features permit making the operation of the apparatus more reliable, productive and effective.

The batcher housing is preferably transversally split at the portion corresponding to the connection of the passage to the hopper. The non-return valve preferably comprises a flexible diaphragm clamped between the parts of the split housing and has a through hole which is coaxial with the passage and interconnects the passage with a space below the hopper bottom. The bottom of the hopper has through holes arranged over the periphery thereof for passage of pulverulent coating material and is provided with a conical projection opposite to the diaphragm hole which forms a seat closing the diaphragm hole upon bending of the diaphragm at the moment of back impact.

This construction simplifies and accelerates the assembly of the hopper and batcher in the manufacture and maintenance of the apparatus, and the provision of the split housing facilitates the access to the diaphragm of the non-return valve and to the device for controlling the cross-sectional area of the passage disposed below the diaphragm in the batcher passage for inspection, cleaning and repair.

It should be noted that the provision of the seat of the non-return valve on the lower surface of the hopper bottom enables more reliable closure of the diaphragm hole, thereby preventing gases from breaking-through into the hopper upon back impact from the explosion chamber.

The hopper may accommodate a coaxial pipe of a gas-permeable material having an upper end extending through an opening in the hopper cover and communicating with a source of compressed gas, the lower end of the pipe bearing against the conical projection of the hopper bottom and having holes equally spaced over the periphery of the pipe for passage of gas to the hopper, the axes of the hole extending at the same angle to the hopper bottom.

This construction enables an additional improvement of fluidity of pulverulent coating material at the point of its entrance to the batcher passage and, at the same time, a positive feeding of the material to the jet nozzle of the mixing chamber of the batcher.

The device for controlling the cross-sectional area of the batcher passage is peferably made of a pipe of a flexible material coaxial with the passage and an adjusting rod and an electromagnetic valve mounted on either side of the pipe coaxially with each other and cooperating with the pipe to control the cross-sectional area thereof.

The provision of the adjusting rod and electromagnetic valve enable an accurate control of the cross-sectional area of the flexible pipe and, consequently of the batcher passage, thereby ensuring accurate metering of the pulverulent coating material.

Furthermore, the electromagnetic valve enables the control of the feeding of batches of powder to the explosion chamber and, if necessary, it completely closes the pipe to guarantee the interruption of the material supply.

In accordance with one embodiment of the invention, the mixing chamber of the batcher communicates with the explosion chamber via an inlet pipe having one end disposed within the through axial hole of the closed end of the explosion chamber.

This construction provides optimum conditions for feeding pulverulent coating material to the explosion chamber and for the formation therein of a uniform two-phase flow of explosive mixture and powder, thereby facilitating an improvement of the quality of coating application.

The above-described connection of the mixing chamber of the batcher to the explosion chamber is preferably used in small-sized apparatus with an axial feeding of pulverulent coating material which are designed for explosive application of coatings preferably of pulverulents of the same materials.

In accordance with another embodiment of the invention, the explosion chamber is made composite lengthwise thereof and consists of two telescopically interconnected parts of which the terminal part is arranged outside and partially encloses the second part which accommodates a spark plug and terminates in a jet nozzle. An inner space is defined therebetween and the zone of interconnection of the parts of the explosion chamber is surrounded by an annualar casing which defines, in combination with the terminal part, a space communicating with said inner space and with the mixing chamber of the batcher.

The provision of the composite explosion chamber consisting of two telescopically interconnected parts defining a space in the zone of their interconnection enables the constant volume of explosive mixture required for explusion of powder from the explosion chamber to be maintained, as well as a strictly determined acceleration portion at which the energy of flow of explosion products is transmitted to the particles of the coating material. It is also one of the important factors influencing the provision of uniform coatings having high performance capacity.

The arrangement of the open-ended part of the explosion chamber outside of the inner part thereof which terminates in the jet nozzle enables a considerable increase in the velocity of flow of explosion products at the outlet of the jet nozzle and provides for an inflow of powder from the batcher due to reduced pressure established at the end of the jet nozzle, thereby utilizing the energy of the flow of explosion products for transporting pulverulent coating material to the explosion chamber.

The provision of the annular casing communicating, on one side, with the batcher and, on the other side, with the space accommodating the jet nozzle, enables a preliminary charging of the powder with relatively small dimensions of the explosion chamber and, which is most important, protection of the batcher against eventual back impacts and break-through of flame therein, thereby providing for high reliability of the apparatus in operation.

The casing space preferably communicates with the inner space of the terminal part of the explosion chamber via passages provided in the walls of the terminal part of the chamber which are equally spaced along the circumference thereof and have their axes inclined in the direction opposite to the location of the open end of the explosion chamber at the same angle, the outlet openings of the passages being preferably arranged behind the outlet opening of the jet nozzle relative to the open end of the explosion chamber.

This construction enables a more uniform and efficient supply of pulverulent coating material to the inner space of the explosion chamber accommodating the jet nozzle, and also an inflow of powder from the batcher due to reduced pressure provided by the nozzle.

The amount of the distance from the axes of the outlet openings of the passages of the walls of the terminal part of the explosion chamber to the axis of the spark plug may be selected within the range of about 15 to 60 times the inside diameter of the inner part of the explosion chamber.

This feature enables the selection of optimum dimensions of the explosion chamber and more accurate determination of the point of admittance of pulverulent coating material thereto with minimum distribution thereof lengthwise of the explosion chamber, thereby improving the economical effectiveness of the apparatus.

The amount of the distance from the axes of the outlet openings of the passages of the walls of the terminal part of the explosion chamber to the open end thereof may be within the range of about 15 to 60 times the inside diameter of the end portion.

The selection of the length of the terminal part of the explosion chamber within the above range enables a more complete utilization of the energy of combustion products of a gaseous mixture, depending on the coating material, to accelerate and to move the particles of pulverulent coating material, thereby obtaining more uniform coatings featuring high performance properties.

The walls of the terminal part of the explosion chamber are preferably provided with a tapered portion narrowing toward the open end of the explosion chamber, and this portion is conjugated, by a cylindrical portion and a portion with a reverse taper, with a cylindrical portion located adjacent to the open end of the explosion chamber.

This construction enables a considerable increase in the velocity of the stream of explosion products at the outlet of the jet nozzle and the provision of an inflow of the powder from the batches due to reduced pressure provided by the nozzle.

BRIEF DESCRIPTION OF THE DRAWINGS

The invention will now be described with reference to the accompanying drawings, in which.

DETAILED DESCRIPTION OF THE INVENTION

Figure 1:
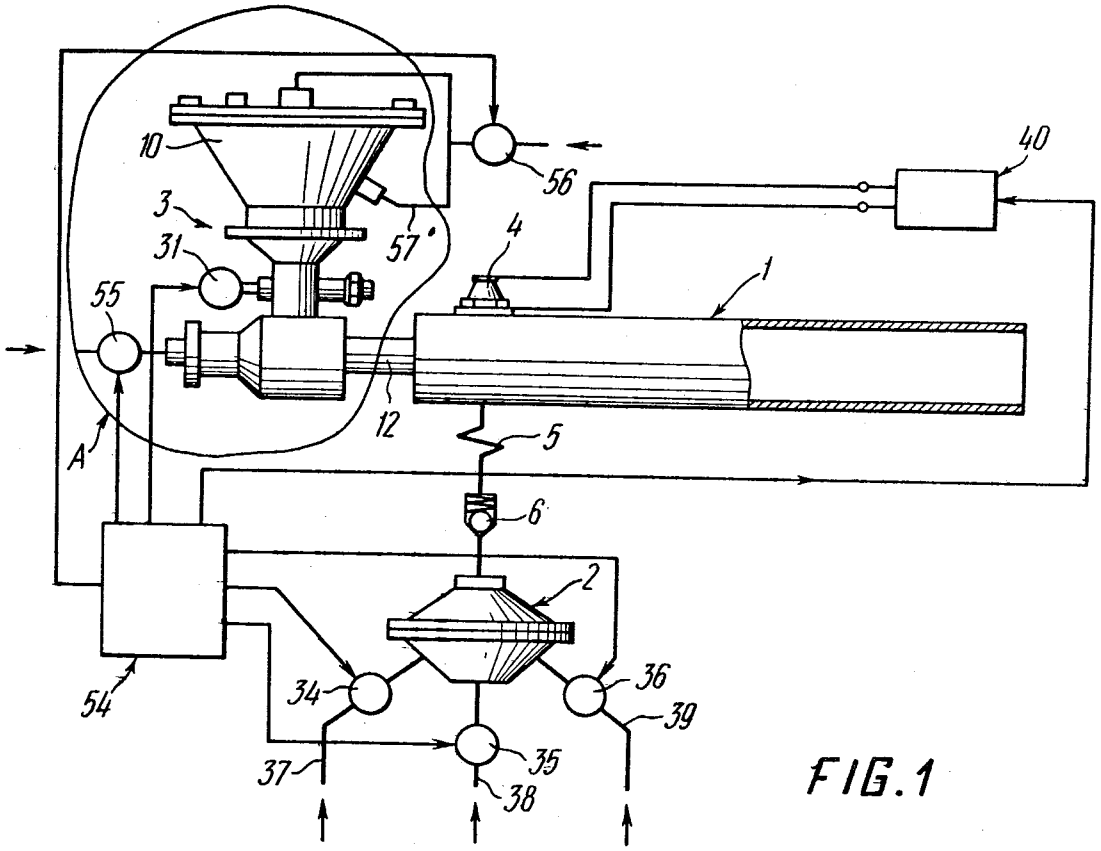
FIG. 1 is a schematic diagram showing a general view of a first embodiment of the apparatus for explosive application of coatings according to the invention.

The apparatus for explosion application of coatings comprises an explosion preparation chamber 1 (FIG. 1), a chamber 2 for preparation of explosive mixture and a batcher 3 for metering pulverulent coating material which communicate therewith.

The explosion chamber 1 is made in the form of a calibrated cylindrical tube closed at one end and accommodating a spark plug 4 mounted at the closed end. The explosion chamber 1 communicates with the chamber 2 for preparation of explosive mixture via a protective pipe 5, made as a coil, and a protective valve 6.

The batcher 3 for pulverulent coating material has a housing 8 (FIG. 2) accommodating a mixing chamber 9 provided with a passage 11 connecting it to a hopper 10.

In the first embodiment (FIG. 1), the mixing chamber 9 of the batcher 3 of the apparatus for explosive application of coatings is arranged coaxially with the explosion chamber 1 and communicates therewith via an inlet pipe 12 having one end thereof mounted within a through axial hole of the closed end of the explosion chamber 1.

A jet nozzle 13 (FIG. 2) is mounted coaxially within the mixing chamber 9 of the batcher 3 for positively feeding pulverulent coating material "B" to the explosion chamber 1.

A longitudinal passage 14 of the nozzle 13 communicates with a source of compressed gas (not shown) which is used for transporting the powder.

Walls 15 of the hopper 10 are arranged to define a truncated cone converging downwards and are conjugated with a bottom 16 of the hopper. The hopper 10 is closed at the top by a cover 17 having an opening for pouring the powder "B" into the hopper 10.

According to the invention, a partition wall 18 is mounted within the hopper 10 in equally spaced relation to the walls 15 thereof, the partition wall being made of a gas-permeable material to define an annular space 19 communicating with a source of compressed gas.

In addition, the hopper 10 accommodates a pipe 20 coaxial therewith which is also made of a gas-permeable material, the upper end of the pipe extending through the opening of the cover 17 of the hopper 10 and communicating with the compressed gas source, and the lower end of the pipe bearing against a conical projection 21 of the bottom 16 of the hopper 10 and having through holes 22 equally spaced over the periphery of the pipe 20 for passage of gas to the inner space of the hopper 10. The axes of the holes 22 being inclined at the same angle to the bottom 16 of the hopper 10.

The gas-permeable material for making the partition wall 18 and the pipe 20 may comprise a cermet composition or any other suitable material (such as felt, metal network, coarse calico) having a void ratio sufficient for free filtration of gas from the annular space 19 and inner space of the pipe to the inner space of the hopper 10.

It is to be understood that the gas-permeable material should not permit even the finest pulverulent coating material "B" to pass from the inner space of the hopper 10.

Filtration of gas into the inner space of the hopper 10 through the gas-permeable partition wall 18 and pipe 20 ensures elimination of self-compaction of powders, especially very fine powders at the hopper walls during operation of the apparatus and provides for an unobstructed flow of the powder into the passage 11 of the batcher 3.

The housing 8 of the batcher 3 is transversally split at the portion corresponding to the connection of the passage 11 to the hopper 10, the joint being formed by flanges 23 and 24 interconnected by means of circumferentially spaced screws 25.

A non-return valve is mounted in the passage 11 of the housing 8 of the batcher 3 at the portion connected to the hopper 10 for closing the passage 11 upon back impact from the explosion chamber 1.

The non-return valve comprises a flexible diaphragm 26 clamped between the flanges 23 and 24 and having a through hole 27 coaxial with the passage 11 which establishes communication of the passage 11 with a space below the bottom 16 of the hopper 10. The hopper bottom 16 is provided with peripheral through holes for passage of pulverulent coating material to the passage 11. A conical projection 28 is provided on the bottom 16 opposite the hole 27 of the diaphragm 26, and this projection is used as a seat of the non-return valve which closes the hole 27 of the diaphragm 26 upon bending thereof at the moment of back impact.

A device for controlling the cross-sectional area of the passage 11 is mounted within the passage 11 of the housing 8 of the batcher 3.

The device comprises a flexible pipe 29, an adjusting rod 30 and an electromagnetic valve 31 closing the passage 11 which are arranged on either side of the pipe.

A batch of powder is adjusted by means of the adjusting rod 30 which is mounted in a through threaded hole of the housing 8 of the batcher 3 coaxially with a rod 32 of the electromagnetic valve 31 and is locked by means of a nut 33.

By rotating the adjusting rod 30 the space between the adjusting rod and the rod of the electromagnetic valve 31 is adjusted to vary the cross-sectional area of the flexible pipe 29 along which the pulverulent coating material "B" flows from the hopper 10 to the mixing chamber 9 of the batcher 3.

The chamber 2 for preparation of explosive mixture (FIG. 1) communicates, via electromagnetic valves 34, 35 and 36 mounted in inlet pipelines 37, 38 and 39, respectively, with sources of components of explosive mixture (not shown).

In this embodiment, the valve 34 connects the chamber 2 of a source of an oxidizer (oxygen), the valve 35 connects the chamber to a source of a neutral gas (nitrogen), and the valve 36 is used for feeding fuel (acetylene).

In addition to the above-mentioned working members, the apparatus comprises a high-voltage generator 40 feeding pulses to the spark plug 4 for ignition of the explosive mixture.

Figure 3:
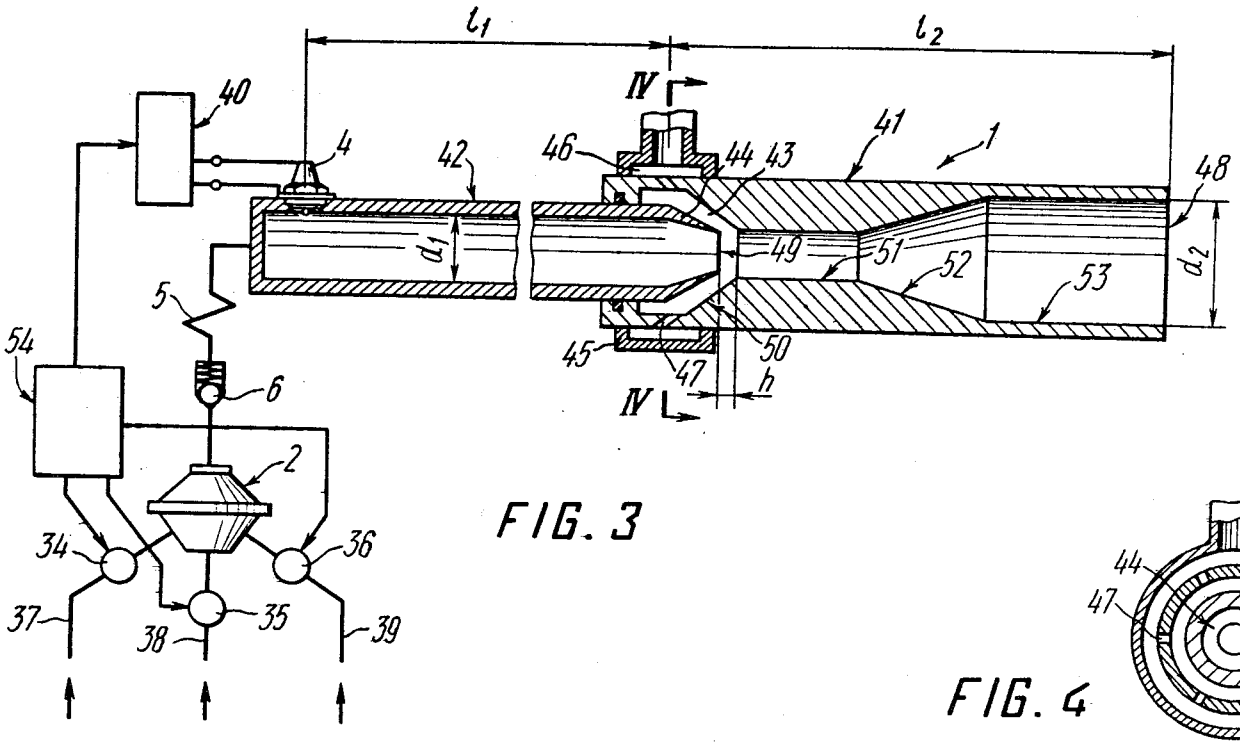
FIG. 3 is a schematic view, partly in section, of a second embodiment of the apparatus for explosive application of coatings according to the invention.

In the second embodiment of the apparatus for explosive application of coatings shown in FIG. 3, the explosion chamber 1 is made composite lengthwise and consists of two telescopically interconnected parts 41 and 42 of which the terminal part 41 (the right-hand part in FIG. 3) of the explosion chamber 1 is arranged outside and partially encloses the second, inner part 42 with the formation of an inner space 43 between both parts.

The second part 42 of the explosion chamber 1 terminates in a jet nozzle 44 mounted within the space 43 and, in addition, the spark plug 4 is mounted within the second part 42 adjacent to the closed end of the explosion chamber 1.

Figure 2:
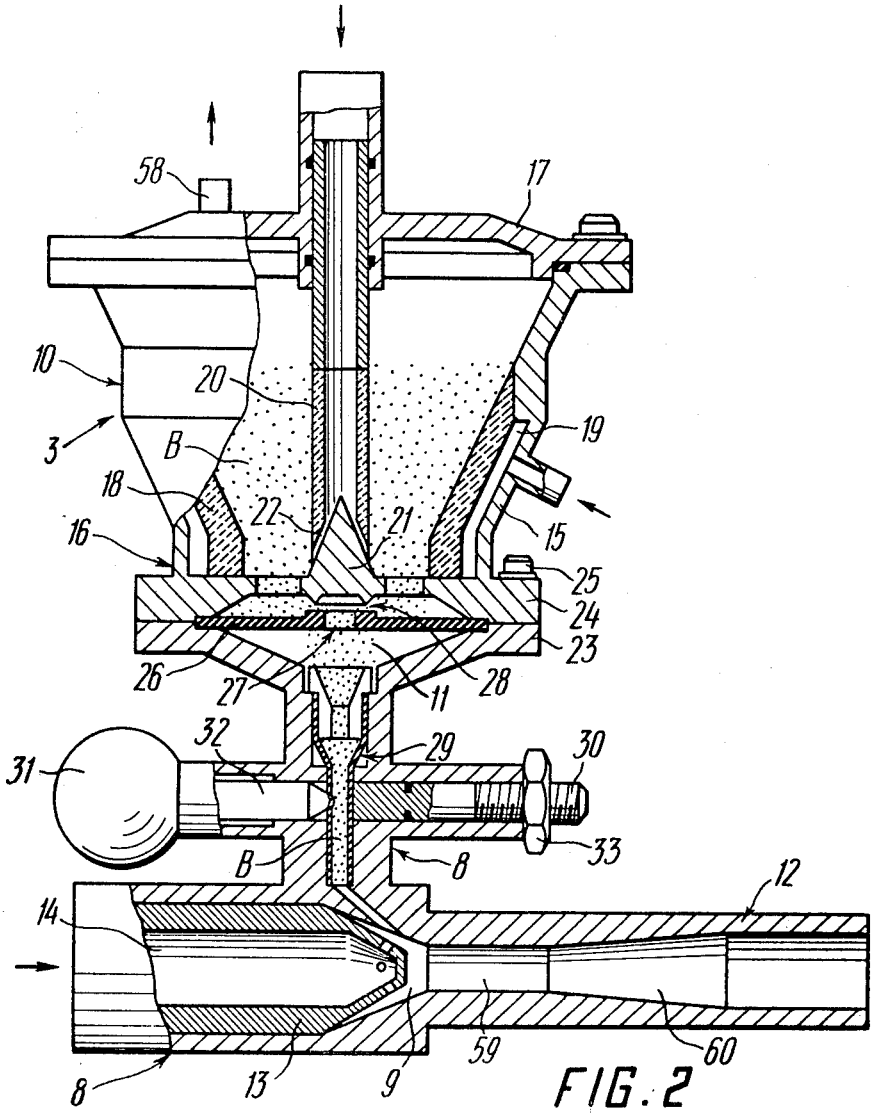
FIG. 2 is a longitudinal view, partly in section and partly broken away, of area "A" in FIG. 1.

The zone of interconnection of the parts 41 and 42 of the explosion chamber 1 is surrounded by an annular casing 45 which defines, in combination with the terminal part 41, a space 46 communicating with the inner space 43 accommodating a jet nozzle 44 and with the mixing chamber 9 of the batcher 3 (FIG. 2).

Figure 4:
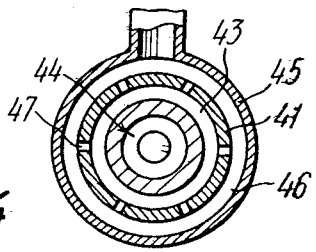
FIG. 4 is a cross sectional view taken along the line IV—IV in FIG. 3.

The space 46 of the casing 45 communicates with the space 43 accommodating the jet nozzle 44 via passages 47 (FIGS. 3 and 4) provided in the walls of the terminal part 41 of the explosion chamber 1 which are equally spaced over the periphery thereof. Axes of the passages 47 are inclined in the direction opposite to the open end 48 (FIG. 3) of the explosion chamber 1 at the same angle. It should be noted that the outlet openings of the passages 47 terminating in the space 43 are located, relative to the open end 48 of the explosion chamber, behind the outlet opening 49 of the jet nozzle 44.

It has been experimentally proved that the amount of the distance $l_1$ from the axes of the outlet openings of the passages 47 to the axis of the spark plug 4 should be selected within a range of about 15 to 60 times the inside diameter $d_1$ of the inner part 42 of the explosion chamber 1.

The amount of the distance $l_2$ from the axes of the outlet openings of the passages 47 in the walls of the terminal part 41 of the explosion chamber 1 to the open end 48 thereof should be selected within a range of about 15 to 60 times the inside diameter $d_2$ of the open end 48.

The walls of the space 43 defined between the parts 41 and 42 of the explosion chamber 1 comprise a tapered portion 50 narrowing toward the open end 48 of the explosion chamber 1, and this tapered portion is conjugated, by a cylindrical portion 51 and a portion 52 with reverse taper, with a cylindrical portion 53 located adjacent to the open end 48 of the explosion chamber 1.

In order to ensure optimum conditions for operation of the jet nozzle 44, the distance "h" (FIG. 3) from the outlet opening 49 thereof to the inlet of the cylindrical portion 52 of the terminal part 41 of the explosion chamber 1 may be adjusted by displacing the inner part 42 of the explosion chamber 1, together with the nozzle 44, in the axial direction.

The first embodiment of the apparatus for explosive application of coatings (FIG. 1) functions in the following manner.

An electronic control unit 54 (FIG. 1) feeds pulses (the direction of pulses is indicated by arrows in FIG. 1) to the electromagnetic control valves 31, 34, 35, 36, 55 and 56, in accordance with a preset cyclogram. The control unit 54 also feeds a signal to the high-voltage pulse generator 40 which feeds a pulse to the spark plug 4 for ignition of the explosive mixture in the explosion chamber 1.

During the entire operating cycle of the apparatus, the valve 56 is open to provide for urging and feeding of gas, via a pipeline 57, to the annular space 19 (FIG. 2) of the hopper 10 and therefrom, via the filtering partition wall 18 and the walls of the pipe 20, into the inner space of the hopper 10 to loosen the pulverulent coating material "B". The gas is then drained into the atmosphere via a pipe 58 in the cover 17 of the hopper 10.

At the beginning, following the command from the electronic control unit 54, the electromagnetic valves 34, 35 and 36 (for an oxidizer, neutral gas and fuel, respectively) are open, and the valve 35 for neutral gas may take either of two positions ("open" or "closed") depending on what proportion of components should be selected for the explosive mixture.

The valve 35 may be used for adjusting, over a wide range, the temperature, pressure and velocity of the detonation wave by adding various batches of neutral gas to the mixture, whereby required operating conditions for various coating materials may be rapidly set-up.

Upon opening of the valves 34, 35 and 36, the oxidizer, neutral gas and fuel are fed to the chamber 2 wherein they are mixed together to form a uniform explosive mixture which passes through the non-return valve 6 and the protective pipe 5 to fill the explosion chamber 1.

The amount of the pulverulent coating material "B" is determined by the batcher 3 which functions in the following manner.

Following the command from the control unit 54, the valves 31 and 55 are concurrently open. Upon actuation of the valve 31, the rod 32 thereof is retracted to open the flexible pipe 29.

Under the action of the gas flow fed, via the valve 55, into the passage 14 of the nozzle 13, reduced pressure is established in the mixing chamber 9 of the batcher 3 and, as a result, the powder "B" flows in the chamber 9 from the flexible pipe 29 to which the powder is fed from the hopper 10 through the holes in the bottom 16 thereof and through the hole 27 of the diaphragm 26.

The transporting gas, together with the powder "B" from the mixing chamber 9, is fed to the cylindrical portion 59 of the pipe 12 in which they are mixed together and, after passing through a diverging cone 60, are admitted to the explosion chamber 1.

After the explosion chamber 1 is filled with the explosive mixture and with the pulverulent coating material, all valves are closed, and the control unit 54 feeds a signal for opening of the valve 35 for neutral gas to purge the chamber 2. Thereafter, a signal is fed to the generator 40 which feeds a pulse to the spark plug for initiation of the explosive mixture in the explosion chamber 1.

As a result of the detonation of the explosive mixture in the explosion chamber 1, there are established a high pressure and temperature and an intensive release of gaseous explosion products occurs which are strongly compressed at the moment of detonation so as to constitute the physical agent whose conversion results in an instantaneous transformation of potential energy of the explosive mixture into kinetic energy of moving gases. This energy is transmitted to the particles of the pulverulent coating material suspended in the gas flow so that they are heated, accelerated and expelled from the open end of the explosion chamber 1 to form a coating on the surface of a workpiece (not shown).

After the above-described process is completed, the explosion chamber 1 is purged with neutral gas from the same valve 35. Then the cycle may be repeated.

The operation of the second embodiment of the apparatus for explosive application of coatings (FIG. 3) differs from the operation of the first embodiment in the following manner.

After the neutral gas has expelled the residues of the explosive mixture from the chamber 2 for preparation of the explosive mixture, the explosive mixture is initiated in the inner space of the inner part 42 of the explosion chamber 1.

As a result of the detonation of the explosive mixture, a high-velocity flow of combustion products is formed which precipitates at a high speed through the jet nozzle 44 to the space 43 wherein this flow provides a reduced pressure at the outlet opening 49 of the nozzle 44, and this reduced pressure creates an inflow of pulverulent coating material from the batcher 3 into the space 46 of the annular casing 45 and further, via the passages 47, to the space 43.

Therefore, the energy of the flow of explosion products is utilized for creating the inflow and for transporting pulverulent coating material to the explosion chamber 1. In addition, since this flow is strongly turbulized at the entrance of the cylindrical portion 51 of the terminal part 41 of the explosion chamber 1, substantially complete mixing of the powder and explosive mixture is ensured.

Due to a peculiar character of the supersonic flow, the flow of explosion products with suspended particles of pulverulent coating material, having passed the portion 52 with the inverse taper in the terminal part 41 of the explosion chamber 1, acquires a still higher velocity which, along with high temperature, is the most important factor for the formation of coatings of uniform composition with minimum void ratio, exhibiting a strong bond with a workpiece and high performance properties.

Both embodiments of the apparatus according to the invention are highly reliable in operation and provide complete safety of all assemblies and units which enables an improved efficiency in using pulverulent coating materials.

When applying coatings of various materials, the processing parameters should be varied, hence the performance of the apparatus should be modified depending on properties of specific materials. The advantage of the above-described apparatus according to the invention as compared with the conventional apparatus is the simplicity and convenience of modification of performance conditions which is accomplished by merely turning knobs of respective switches at the control board, so that no great skill is required for effecting explosive application of coatings in accordance with a preset cycle program.

Both embodiments of the apparatus may be used successfully for applying multilayer coatings of pulverulents of various materials. With this aim in view the casing may be provided with a number of inlet connections (not shown) coupled with batchers similar to those described-above filled with pulverulents of various materials. By turning on said batchers in a certain sequence it is possible to obtain multilayer coatings and the thickness of layers in said coatings may be controlled by an operator in accordance with a given technology directly from a control desk without stopping the apparatus.

What is claimed is:

1. An apparatus for the explosive application of coatings comprising: a composite lengthwise explosion chamber having telescopically interconnected terminal and inner parts, said terminal part being arranged outside and partially enclosing said inner part, said inner part accommodating at least one spark plug and terminating in a jet nozzle, an inner space being defined between said terminal and inner parts, and the zone of interconnection of said terminal and inner parts of said explosion chamber being surrounded by an annular casing which defines, with said terminal part, a space communicating with said inner space; a batcher for metering pulverulent coating material; a preparation chamber for preparation of an explosive mixture communicating with said explosion chamber; a mixing chamber of said batcher communicating with said explosion chamber; a jet nozzle mounted in said mixing chamber for positively feeding the pulverulent coating material to said explosion chamber; a hopper communicating with said mixing chamber via a passage; a device mounted in said passage for controlling the cross-section area of said passage; a non-return valve mounted in a portion of said passage connected to said hopper to close the passage upon back impact of an explosion wave from said explosion chamber; and a partition wall of a gas-permeable material mounted within said hopper in equally spaced relation to walls of said hopper to define an annular space and communicating with a source of compressed gas, said compressed gas passing through said partition wall to prevent the pulverulent coating material in said hopper from being self-compacted.

2. An apparatus according to claim 1, wherein the space of the casing communicates with the space of the terminal part of the explosion chamber via passages made in the walls of the casing which are equally spaced over the periphery of the terminal part and inclined in the direction opposite to the open end of the explosion chamber at the same angle, the outlet openings of the passages being located, relative to the open end of the explosion chamber, behind the outlet opening of the jet nozzle of the inner part.

3. An apparatus according to claim 2, wherein the distance from the axes of the outlet openings of the passages in the walls of the terminal part of the explosion chamber to the axis of the spark plug is about 15 to 60 times the inside diameter of the inner part of the explosion chamber.

4. An apparatus according to claim 2, wherein the distance from the axes of the outlet passages in the walls of the terminal part of the explosion chamber to the open end of the explosion chamber is about 15 to 60 times the inside diameter of the open end portion.

5. An apparatus according to claim 1, wherein the mixing chamber of the batcher communicates with the explosion chamber, via an inlet pipe having one end thereof mounted within a through axial hole made in the closed end wall of the explosion chamber.

* * * * *